US008161688B2

(12) United States Patent
Railkar

(10) Patent No.: US 8,161,688 B2
(45) Date of Patent: Apr. 24, 2012

(54) OUTSIDE CORNER PATCH FOR TPO ROOFING

(75) Inventor: Sudhir Railkar, Wayne, NJ (US)

(73) Assignee: Building Materials Investment Corp., Wilmington, DE (US)

( * ) Notice: Subject to any disclaimer, the term of this patent is extended or adjusted under 35 U.S.C. 154(b) by 130 days.

(21) Appl. No.: 12/351,218

(22) Filed: Jan. 9, 2009

(65) Prior Publication Data

US 2010/0175342 A1 Jul. 15, 2010

(51) Int. Cl.
*E04D 1/36* (2006.01)

(52) U.S. Cl. ..... 52/58; 52/219; 52/287.1; 52/408

(58) Field of Classification Search ..... 52/58, 219, 52/287.1, 408
See application file for complete search history.

(56) References Cited

U.S. PATENT DOCUMENTS

| | | | | | |
|---|---|---|---|---|---|
| 3,325,953 | A | * | 6/1967 | Alleaume | 52/276 |
| 4,330,581 | A | * | 5/1982 | Borgert et al. | 428/66.4 |
| 4,462,190 | A | * | 7/1984 | Allen | 52/58 |
| 4,598,505 | A | * | 7/1986 | McGown | 52/58 |
| 4,603,517 | A | * | 8/1986 | Lyons, Jr. | 52/60 |
| 4,781,008 | A | * | 11/1988 | Lyons, Jr. | 52/656.1 |
| 4,799,986 | A | * | 1/1989 | Janni | 156/196 |
| 4,872,296 | A | * | 10/1989 | Janni | 52/58 |
| 4,969,250 | A | * | 11/1990 | Hickman et al. | 29/521 |
| 5,072,552 | A | * | 12/1991 | Sauder | 52/58 |
| 5,077,943 | A | * | 1/1992 | McGady | 52/58 |
| 5,414,964 | A | * | 5/1995 | Bodycomb | 52/58 |
| 5,706,610 | A | * | 1/1998 | Mayle | 52/60 |
| D400,080 | S | * | 10/1998 | Beard, Jr. | D8/354 |
| 5,896,711 | A | * | 4/1999 | McClure | 52/200 |
| 5,983,592 | A | * | 11/1999 | Mayle | 52/746.11 |
| 6,070,370 | A | * | 6/2000 | Locke | 52/58 |
| 6,122,874 | A | * | 9/2000 | Smerilli | 52/408 |
| 6,199,326 | B1 | * | 3/2001 | Mayle | 52/58 |
| 6,457,279 | B1 | * | 10/2002 | Jacobsen et al. | 52/58 |
| 6,681,530 | B1 | * | 1/2004 | Givens | 52/58 |
| 6,715,237 | B2 | * | 4/2004 | Batt, Sr. | 52/11 |
| 6,754,993 | B1 | * | 6/2004 | Mayle et al. | 52/58 |
| 6,892,782 | B1 | * | 5/2005 | Mayle | 156/581 |
| 7,373,729 | B2 | * | 5/2008 | Mossot et al. | 33/527 |
| 7,638,180 | B2 | | 12/2009 | Nebesnak | |
| 2003/0150175 | A1 | * | 8/2003 | Rillie | 52/200 |
| 2004/0074156 | A1 | * | 4/2004 | Haynes | 52/58 |
| 2005/0055889 | A1 | * | 3/2005 | Thaler | 52/58 |
| 2005/0166471 | A1 | * | 8/2005 | Allen | 52/58 |
| 2005/0268561 | A1 | * | 12/2005 | Lane et al. | 52/58 |
| 2006/0053699 | A1 | * | 3/2006 | Lolley et al. | 52/58 |
| 2006/0130411 | A1 | * | 6/2006 | Edgar et al. | 52/58 |
| 2009/0090068 | A1 | * | 4/2009 | O'rourke | 52/58 |
| 2009/0277102 | A1 | * | 11/2009 | Bishop et al. | 52/58 |

* cited by examiner

*Primary Examiner* — Brian Glessner
*Assistant Examiner* — Joshua Ihezie
(74) *Attorney, Agent, or Firm* — Womble Carlyle Sandridge & Rice, LLP

(57) ABSTRACT

An outside corner patch for TPO roofing is formed from a circular piece of TPO membrane material being vacuum formed to define an array of flutes that extend from the center of the piece toward its edges. The flutes form ridges and valleys that generally are shaped as conical sections with the apex of the conical sections located at the center of the patch. The number and size of the flutes is optimized in such a way that, when the flutes are stretched flat, the patch conforms to and fits flat against the surfaces of an outside corner formed by the intersection of a roof deck with an upward protrusion from the roof. The TPO outside corner patch is applied over the corner and thermally welded to surrounding TPO membranes on the roof deck and the protrusion to form a water-tight seal at the outside corner.

15 Claims, 3 Drawing Sheets

OUTSIDE CORNER PATCH FOR TPO ROOFING

TECHNICAL FIELD

This disclosure relates generally to thermoplastic polyolefin (TPO) membrane roofing materials and methods and more particularly to TPO outside corner patches for sealing around vents and other structures that protrude from a roof structure.

BACKGROUND

It is common for commercial and other roofs that are substantially flat to seal the roof with a waterproof membrane such as polymer coated membranes, more commonly referred to as thermoplastic polyolefin membranes or simple TPO membranes. Almost all such roofs include various protrusions that project upwardly from the roof deck such as, for instance, vents, ductwork, air conditioning units, and the like. Providing a water-tight seal around such protrusions, and particularly where the corners of a protrusion meet the flat roof deck, can be a challenge. More specifically, it is possible to wrap the protrusion at least partially with a skirt of TPO membrane with the bottom edge portion of the skirt flaring out to cover and be heat sealed to the roof membrane. However, this requires that the skirt be slit at the bottom of the corners of the protrusion, which leaves a region where the corners meet the flat roof unsealed and subject to leaks.

Corner pieces made from TPO have been developed to address this problem. For example, the Firestone® ReflexEON® inside/outside corner patch is a molded piece of TPO plastic with the general shape of a right angle corner permanently molded in. The molded corner is placed around the bottom corner of a protrusion and the patch is heat sealed to the surrounding TPO membranes to seal the corner. In contrast, GenFlex® TPO reinforced outside corners are factory fabricated corners made from high performance TPO roofing membrane. These are generally made by slitting a square piece of TPO membrane from its center to a corner and then spreading the membrane out at the slit to cause the opposite corner to form a loose pleat. The gap between the spread edges of the slit is then filled in with another piece of TPO membrane, which is heat sealed in place to form a unitary corner patch. In use, the loose pleat is applied around the bottom corner of a protrusion and the patch is heat sealed to surrounding TPO membranes on the roof and the protrusion to form a water-tight seal.

Other examples of attempted solutions can be found in U.S. Pat. Nos. 4,700,512; 4,799,986; 4,872,296; and 5,706,610. It also has been common in the past for installers of membrane roofs to custom make their own corner patches on-site by heating, stretching, cutting, and otherwise manipulating small pieces of TPO membrane. Corner patches and other solutions in the past have not been entirely satisfactory for a number of reasons including that they do not fit well around corners, they must be "bunched up" to fit a corner properly, thus jeopardizing the ability for form a reliable seal, and/or they contain heat sealed joints that can fail and result in a leak. There is a need for a corner patch that addresses satisfactorily the shortcomings and problems of the prior art.

SUMMARY

Briefly described, a patch is disclosed for flat TPO sealed roofs that seals the outside bottom corners of roof protrusions such as vents, ductwork, air conditioning units, where the corners meet the flat roof. In one embodiment, the patch is made of a circular blank of TPO material that is vacuum formed to produce a plurality of radially extending flutes or peaks and valleys in the patch. This is referred to herein as a daisy wheel configuration. The number of flutes, the depth of each flute, and the radius of the blank are optimized according to methods of the invention so that the patch fits an outside bottom corner of a roof protrusion perfectly when the flutes are spread out. The patch can then be heat sealed to surrounding TPO membranes on the protrusion and the roof to provide a water-tight seal where corners of protrusions meet the flat roof. The TPO daisy wheel corner patch of this disclosure also can be optimized for corners that are not orthogonal; i.e. where the sides of the protrusion and the roof do not form right angles with respect to each other. This has not generally been possible with prior art prefabricated corners and has required tedious custom fabricating of corner patches on sight for acceptable results. The patch of this invention also is easily and efficiently packaged because the daisy wheel shape of the patches allows them to be nested together in a compact stack.

Thus, an improved prefabricated TPO corner patch is now provided that fits a corner for which it is designed perfectly to provide a reliable water-tight seal, that is compact and efficient to stack, store, and transport, and that can be optimized for orthogonal and other outside corner shapes commonly encountered in flat or semi-flat commercial roofs. These and other aspects, features, and advantages will be better understood upon review of the detailed description set forth below when taken in conjunction with the accompanying drawing figures, which are briefly described as follows.

DETAILED DESCRIPTION

Figure 1:
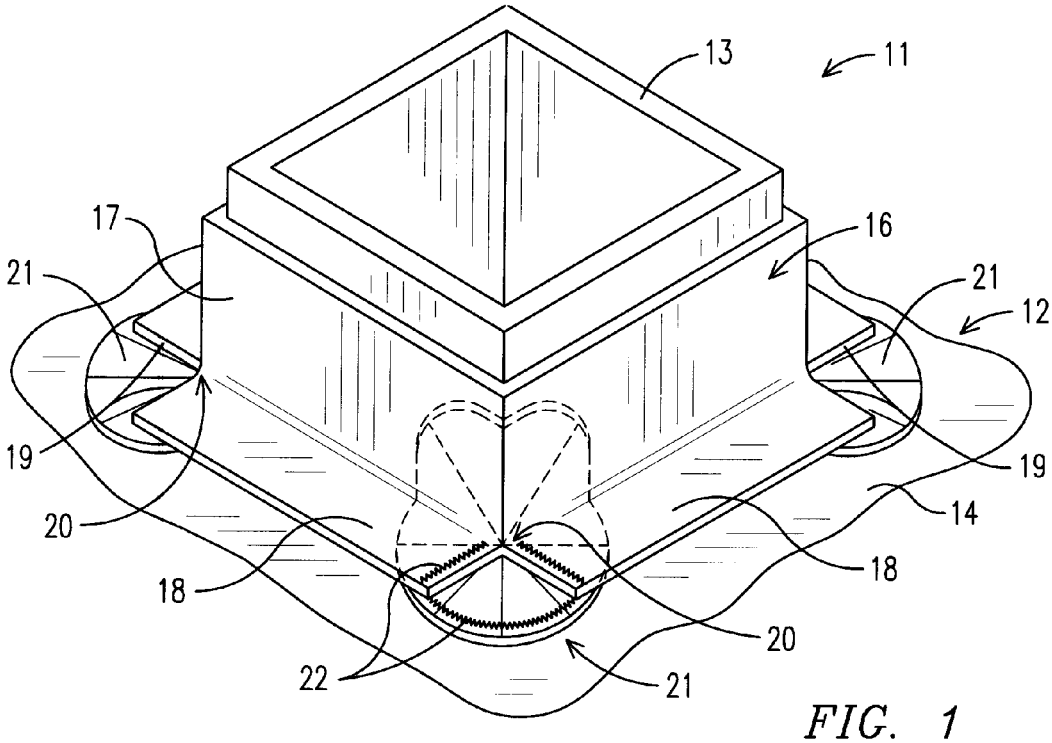
FIG. 1 is a perspective view of a section of a flat TPO sealed roof with a protrusion and illustrates one preferred application of the TPO outside corner patch.

Referring now in more detail to the drawing figures, wherein like reference numerals indicate like parts throughout the several views, FIG. 1 illustrates a section 11 of a flat roof having a protrusion 13. The protrusion is illustrated as a generic square upward projection from the roof deck. In reality, such projections take many forms and protrusion 13 may represent, for example, a chimney, a vent pipe, a duct, and air conditioning platform or unit, or otherwise. In any event, the protrusion 13 and the flat roof deck form outside corners 20 where the corners of the protrusion meet the roof deck. In the illustrated embodiment, the outside corners 20 are orthogonal; that is, the faces of the protrusion and the roof deck all meet at approximately right angles. However, the outside corner patch of this disclosure is not limited to use with orthogonal outside corners but may be optimized for non-orthogonal outside corners.

The flat portion of the roof 11 is covered and sealed with a TPO membrane 14 as is known in the roofing art to prevent water from leaking into the building below. A cutout (not visible) is formed in the membrane at the location of the protrusion and the peripheral edges of the cutout extend up to the bottom of the protrusion. In order to seal along these bottom edges, a skirt or apron 16 of TPO membrane material is wrapped around and sealed to the protrusion 13 with the bottom of the skirt 16 flaring out to overly the membrane 14. More particularly, the skirt 16, when installed, includes an upper portion 17 that covers at least the lower section of the protrusion and flaps 18 that flare outwardly to overly and cover the membrane 14, to which the flaps 18 are thermally welded to form a watertight seal. In order to allow the flaps 18 to extend outwardly, the TPO membrane forming the skirt 16 is slit during installation at the bottom corners of the protrusion, as indicated by reference numeral 19. This leaves an outside corner 20 where the corners of the protrusion and the end of the slit meet the roof deck that is subject to leaks unless properly sealed. Outside corner patches 21 according to the present disclosure are applied to seal these outside corners 20, as detailed below.

An outside corner patch 21 according to the present disclosure is applied at each of the outside corners 20 of the protrusion to form a watertight seal at these corners. Referring to the foreground outside corner in FIG. 1, the outside corner patch 21 comprises a specially formed circular piece of TPO membrane material that has been fluted, as detailed below, to conform to the shape of the outside corner when the patch is spread out. In this illustration, the corner patch 21 is applied beneath the upper portion 17 of the skirt and beneath the two adjacent flaps 18. It will be understood, however, that the patch also may be applied over the top of the upper portion 17 of the skirt and over the top of the two adjacent flaps 18 if desired. In either event, the corner patch 21 is thermally welded to the TPO material of the skirt 16 and the roof membrane 14, as indicated at 22, thus forming a watertight seal at the bottom outside corner of the protrusion. Thermal welding or heat sealing of TPO corners and other members to membranes is well known in the commercial roofing trade and thus the details of this process need not be discussed in detail here.

Figure 2:
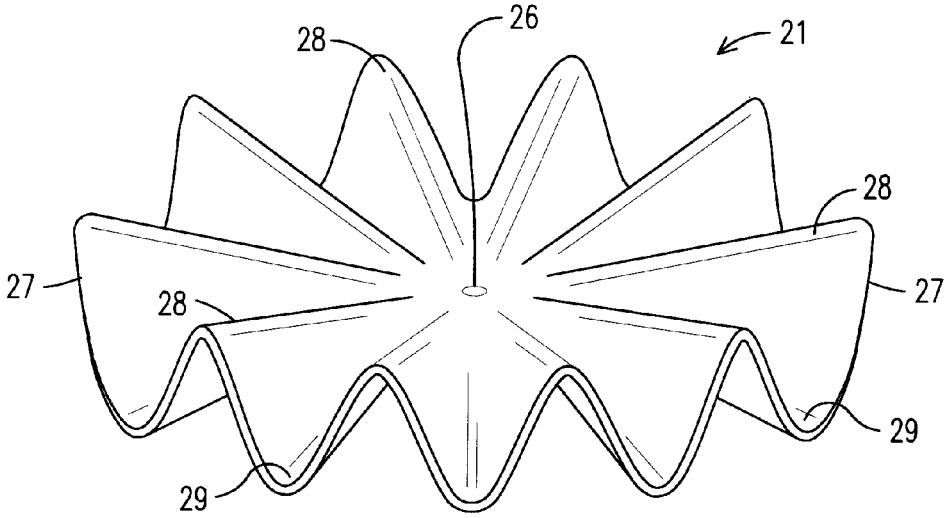
FIG. 2 is a perspective view of a TPO outside corner patch that embodies principles of the disclosure in a preferred form.

FIG. 2 illustrates a preferred configuration of the outside corner patch of this disclosure before being applied to the outside corner of a protrusion, as illustrated in FIG. 1. The patch 21 is generally circular in shape with a central region 26 and a periphery 27 and is radially fluted to define an array of radially extending peaks 28 and corresponding radially extending valleys 29. This forms the daisy wheel configuration of the patch. The peaks and valleys expand in amplitude from substantially zero amplitude at the central region 26 of the patch to a maximum amplitude at the periphery 27 of the patch. The patch 21 can be fabricated in a variety of ways. Preferably, however, a circular cutout of standard TPO membrane material is heated and vacuum formed to generate the daisy wheel configuration with a predetermined number of peaks and valleys. Other possible fabrication methods might include injection molding, thermoforming, pressure molding, or similar known techniques. The patch shown in FIG. 2 is illustrated with 10 peaks and 10 valleys defining the daisy wheel configuration. However fewer or more peaks and valleys might be selected based upon the optimization techniques described in detail below.

For installation of the outside corner patch of this disclosure, the patch is positioned with its central region 26 aligned with and covering the corner where the faces of the protrusion meet the flat roof. The flutes of the patch are then spread out substantially flat as the patch is conformed to the contour of the outside corner. More specifically, the flutes are spread out until the patch lies flat against both of the faces of the protrusion and also lies flat against the flat roofing membrane in the region of the corner. With the number of flutes and the sizes of the flutes optimized for the three dimensional shape of the outside corner, the patch conforms perfectly to the faces of the protrusion and the roof when fully spread out. The patch can then be thermally welded or heat sealed to the underlying or overlying, as the case may be, TPO material of the upper portion 17 of the skirt, the flaps 18, and the roof membrane 14 thus forming a watertight seal at the outside corner of the protrusion.

Figure 3:
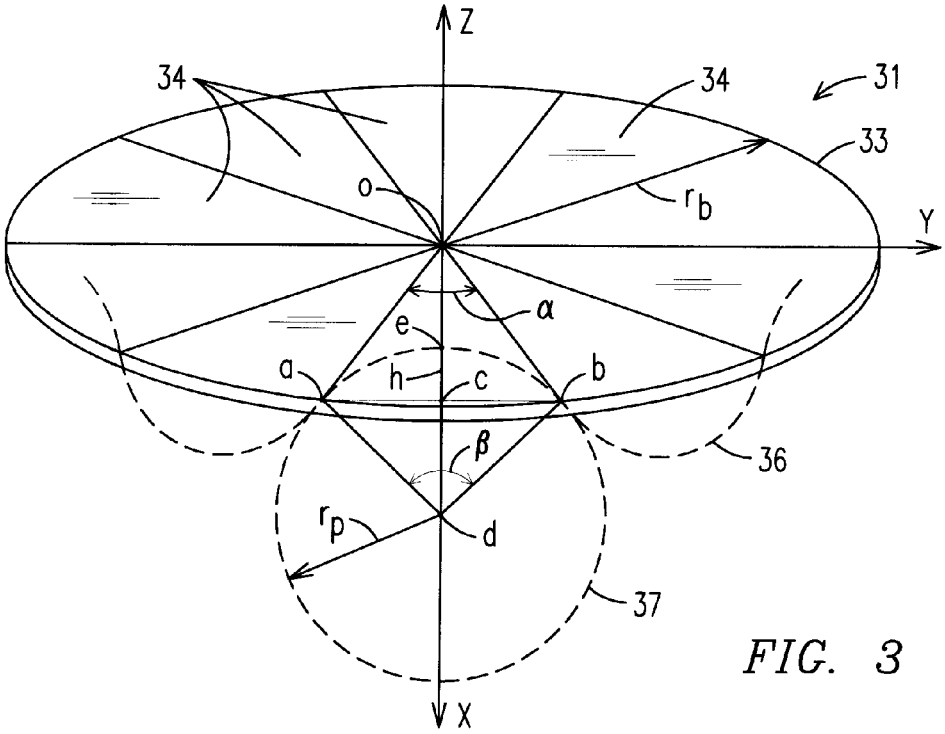
FIG. 3 a perspective view of a circular TPO blank from which the corner patch of this disclosure is molded illustrating design variables for optimizing the number and depth of flutes for a particular corner.

As mentioned above, in order for the outside corner patch of this disclosure to conform perfectly to an outside corner, its configuration, i.e. the number and sizes of the flutes should be optimized for the shape of the outside corner and the diameter of the patch. Most outside corners are orthogonal, but the patch may also be optimized for non-orthogonal outside corners if desired. The optimization methodology described below is for an orthogonal outside corner. FIG. 3 illustrates the design variables that enter into the optimization process. The starting circular blank of TPO material 31 from which the patch is to be formed has a center O, a periphery 33 and can be divided into pie-shaped sections 34, each of which will be deformed into a generally cone-shaped peak or a valley of the final fluted patch, as illustrated by phantom line 36. An imaginary plunge circle 37 may be constructed as an aid in deriving the optimization algorithms. The variables shown in FIG. 3 that are relevant to the optimization process of this invention are defined as follows.

- n: number of flutes (total of peaks plus valleys)
- $r_b$: radius of circular TPO blank
- $r_p$: radius of plunge circle
- $\alpha$: flute blank angle
- h: depth of draw
- $\beta$: flute depth angle
- a, b, c, d, and e identify various useful points on the construction With these optimization variables identified, and with reference to FIG. 3, we see that for triangle oac:

$$\sin(\alpha/2)=ab/2/oa=ab/2/r_b$$

$$\text{Thus: } ab=2r_b\sin(\alpha/2) \quad (1)$$

$$\text{where: } \alpha=2\pi/n \quad (2)$$

Assume that a plunge circle will generate arc aeb when the flat blank is deformed so that the edge of the flute conforms to the plunge circle. Then, for triangle acd, we can see from the Pythagorean theorem for right triangles that:

$$ad^2=ac^2+cd^2$$

$$\text{or: } r_p^2=(ab/2)^2+cd^2 \text{ but } cd+h=r_p$$

$$\text{so: } r_p^2=(ab/2)^2+(rp-h)^2$$

solving this equation for $r_p$ gives:

$$r_p=((ab)^2/4+h^2)/2h \quad (3)$$

$$\text{and: } \sin(\beta/2)=bc/db=ab/2/r_p$$

$$\text{so that: } \beta=2\sin^{-1}(ab/2r_p) \quad (4)$$

Hence, for a given depth of draw "h," the plunge circle radius $r_p$ can be calculated from equation 3. Then, the plunge circle circumference is:

$$2\pi r_p$$

and the length of the flute edge that will follow the contour of the plunge circle when the blank is deformed is:

$$\beta/2\pi\times2\pi r_p \text{ or just } \beta r_p$$

Finally, the total length of the perimeter edge of a fluted patch with n flutes, which we shall designate the "fluted circumference" or $c_f$, is given by the total of the lengths of each individual flute, or:

$$c_f = n\beta r_p \quad (5)$$

Now, referring to FIG. 4, which shows a fluted circular patch stretched flat and conformed to an outside orthogonal corner, and considering that the radius of the fluted patch is equal to the radius of the blank $r_b$, we can determine, using the equation below, the total length of the perimeter of a fluted patch required for the patch to conform perfectly to the corner. We shall call this perimeter length the "design circumference" or simply the "target."

$$(2\pi r_r)+\tfrac{1}{4}(2\pi r_b)=5/4(2\pi r_b) \quad (6)$$

Figure 4:
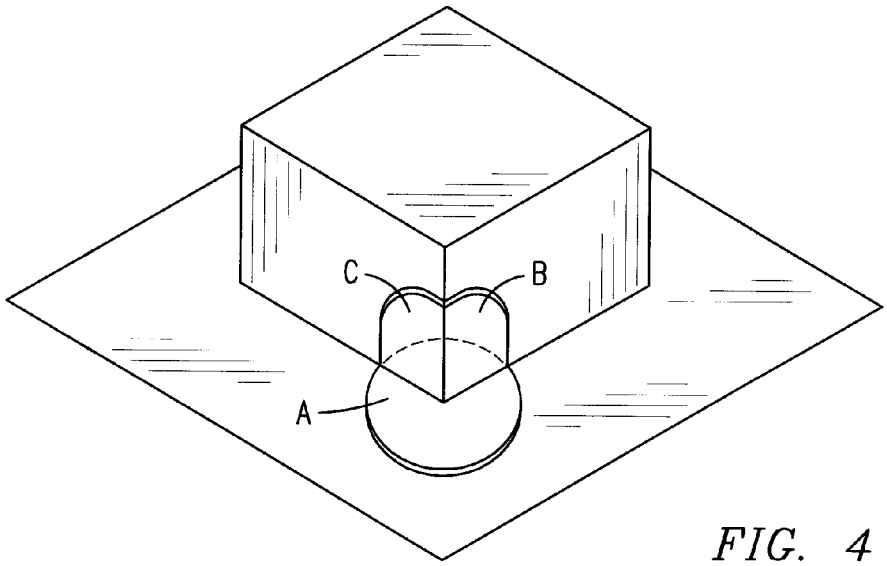
FIG. 4 shows a generic protrusion with a corner patch and illustrates how a design circumference is determined for a patch of a give radius.

The design circumference also can be derived by considering that A in FIG. 4 is ¾ of a circle while B and C are each ¼ of a circle. Adding the circumferences of each of these partial circles gives:

$$\tfrac{3}{4}(2\pi r_b)+\tfrac{1}{4}(2\pi r_b)+\tfrac{1}{4}(2\pi r_b)=5/4(2\pi r_b)$$

Figure 5:
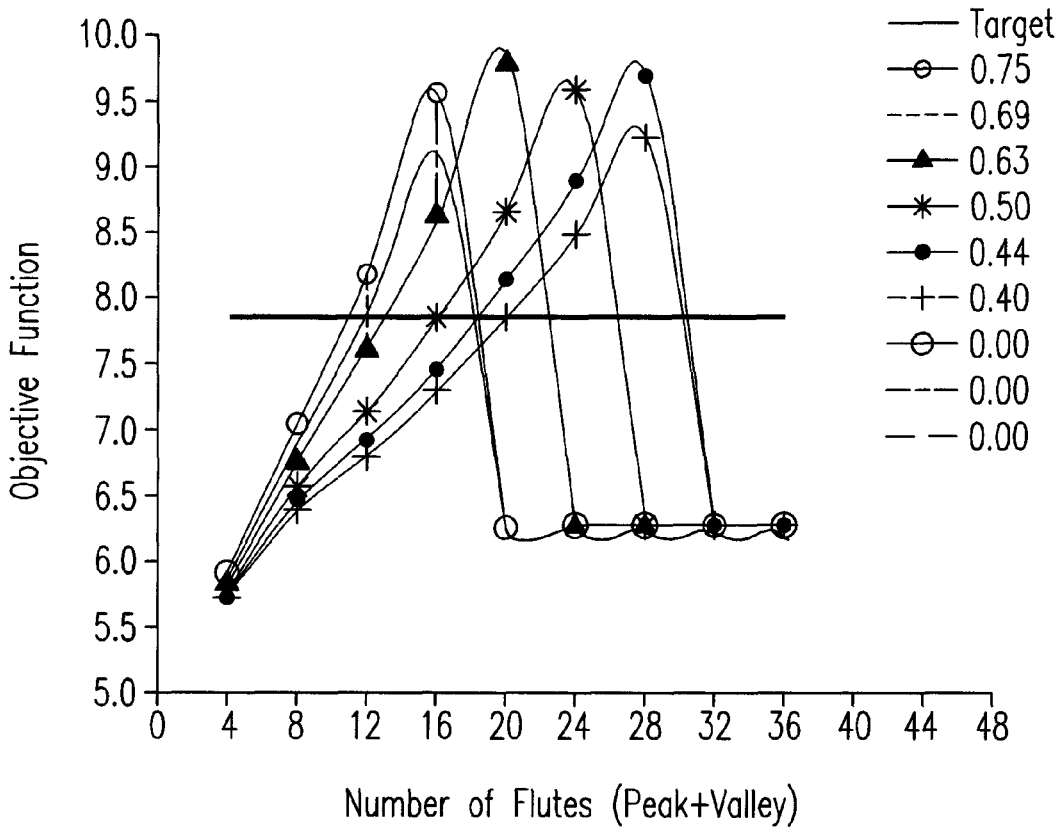
FIG. 5 is a graph illustrating the results of the optimization methodology of the present disclosure.

Hence, optimization routines can be run for a blank of a given radius by selecting various values of flute draw h and, for each value of h, varying the number of flutes n until the combination of h and n generate a fluted circumference $c_f$ that is equal or very close to the design circumference given by equation 6. FIG. 5 illustrates, in the form of a graph, the results of such an iteration to determine the optimum combination of flutes n and flute draw h required for a corner patch having a 4 inch diameter radius to conform perfectly to an outside orthogonal corner. The design circumference or target calculated from equation 6 is represented by the dark horizontal line on the graph. Each curve of the graph represents the fluted circumference $c_f$ for one of the flute draw values shown in the box at the upper right of the graph for various values of the number of flutes n. It will be noted that only the data points on each graph represent a realistic combination of h and n since n must be an even integer.

It can be seen from FIG. 5 that the following combinations of number of flutes n and flute draw h generate, for a four inch radius blank, a fluted circumference that is very close the design circumference:

$n$=12 and $h$=0.69 inch $n$=16 and $h$=0.5 inch and $n$=20 and $h$=0.4 inch

Either of these combinations would result in a fluted patch that would conform to an outside orthogonal corner when stretched out flat. However, due to manufacturing considerations, and to produce a relatively rigid and robust final product, the first combination of n=12 and h=0.69 is considered most optimal.

A four inch radius TPO blank was formed according to the above optimization methodology with 12 flutes and a flute draw of 0.69 inches and was tested on an orthogonal outside corner of a protrusion. The test patch proved to conform perfectly to the corner when placed with its center directly at the corner and its flutes stretched out flat to cover the deck and contiguous sides of the protrusion. Of course, patches of radii other than 4 inches such as, for instance, 2, 6, or 8 inches, can be optimized according to the forgoing methodology so that the radius of the starting TPO blank is not a limitation of the methodology or the invention.

The invention has been described herein in terms of preferred embodiments and methodologies considered by the inventors to represent the best mode of carrying out the invention. However, numerous additions, deletions, and modifications of the illustrated embodiments might be made by those of skill in the art without departing from the spirit and scope of the invention as set forth in the claims. For example, the patch has been described within the context of flat commercial roofing. However, the invention is not limited to flat roofs or commercial roofing but may be adapted for sealing corner protrusions in non-flat roofs. Indeed, the invention may be applied in non-roofing scenarios such as in sheet metal structures, tub and shower basins, and the like where it is desired to seal outside corners of protrusions.

What is claimed is:

1. An outside corner patch comprising a body formed from a substantially circular blank having a radius $r_b$ and a central region, and a number n of substantially conical-section-shaped flutes formed in and radiating outwardly from the central region, wherein the number n and sizes of the flutes is optimized to conform to a selected shape of a corner to which the corner patch is to be applied, whereby each flute comprises a shape defined by a plunge circle located at a periphery of the corner patch and establishing a flute draw h, and wherein n and h for a given $r_b$ substantially satisfy the equation $n\beta r_p \approx 5/4(2\pi r_b)$ where:

β is the flute depth angle, and $r_p$ is the radius of the plunge circle.

2. The outside corner patch of claim 1 and wherein the body is made of a thermoplastic polyolefin membrane.

3. The outside corner patch of claim 1 and wherein the patch conforms to the surfaces of an outside corner when the flutes are spread flat.

4. The outside corner patch of claim 3 and wherein the outside corner is orthogonal.

5. The outside corner patch of claim 1 and wherein each flute comprises a ridge or a valley.

6. The outside corner patch of claim 5 and wherein each flute forms a substantially conical section.

7. An outside corner patch as claimed in claim 1 and wherein $r_b$ is about four inches, n is 12, and h is about 0.69 inch.

8. An outside corner patch as claimed in claim 1 and wherein $r_b$ is about four inches, n is 16, and h is about 0.5 inch.

9. An outside corner patch as claimed in claim 1 and wherein $r_b$ is about four inches, n is 20, and h is about 0.4 inch.

10. A roof comprising:

a roof deck;

a protrusion projecting upwardly from the roof deck and forming an outside corner where the protrusion meets the roof deck;

a membrane covering the roof deck;

a membrane at least partially covering the protrusion; and an outside corner patch as claimed in claim 1 covering and sealing the outside corner.

11. The roof of claim 10 and wherein the membranes are made of thermoplastic polyolefin.

12. The roof of claim 11 and wherein the outside corner patch is made of thermoplastic polyolefin.

13. The roof of claim 10 and wherein the membranes and the outside corner patch are bonded to each other to form a substantially watertight seal.

14. The roof of claim 13 and wherein the membranes and the outside corner patch are thermally welded to each other.

15. The roof of claim 14 and wherein the membranes and the outside corner patch are made of a thermoplastic polyolefin material.

* * * * *